US006079425A

United States Patent [19]

Hamer

[11] Patent Number: 6,079,425

[45] Date of Patent: Jun. 27, 2000

[54] BRAID CLIPPER AND SEALING DEVICE

[76] Inventor: Sadie E. Hamer, 300 Franklin St., Woodbine, N.J. 08270

[21] Appl. No.: 09/373,197

[22] Filed: Aug. 12, 1999

[51] Int. Cl.[7] ..... A45D 44/00; A45D 26/00; A41G 3/00; A24C 1/24

[52] U.S. Cl. ..... 132/333; 132/201; 219/223; 30/113

[58] Field of Search ..... 132/333, 75.4, 132/75.5, 75.3, 210, 212, 201; 219/223, 225, 227; 30/113

[56] References Cited

U.S. PATENT DOCUMENTS

| | | | |
|---|---|---|---|
| 5,345,952 | 9/1994 | Nielander | 30/113 |
| 5,472,654 | 12/1995 | Crawford | 219/223 |
| 5,893,212 | 4/1999 | Meiser | 30/113 |
| 5,946,753 | 9/1999 | Roberts et al. | 30/113 |
| 5,947,280 | 9/1999 | Jimenez | 206/238 |

*Primary Examiner*—John J. Wilson
*Assistant Examiner*—Robyn Kieu Doan

[57] ABSTRACT

A braid clipper and sealing device for easily and carefully cutting braids and sealing the ends of the ends of the braids. The braid clipper and sealing device includes a container having a bottom and top portions and two compartments in the bottom portion, one for receiving cutoff braids and one for storing either lighter fluid or gas, and further includes a recess in the top and a passage extending through the recess into one of the compartments. A first and second blade members are perpendicularly disposed in the passageway with the first blade member being attached to a retractable button which extends through a side of the container. A conduit extends from the compartment containing the fluid or gas and is connected to a burner which is disposed in the recess. A valve which is controlled by a valve control member is disposed in the burner. A rotatable sparking wheel is mounted proximate to the burner for lighting the fluid or gas coming up through the conduit.

9 Claims, 2 Drawing Sheets

BRAID CLIPPER AND SEALING DEVICE

BACKGROUND OF THE INVENTION

1. Field of the Invention

The present invention relates to a braid cutter and braid end sealer and more particularly pertains to a new braid clipper and sealing device for easily and carefully cutting braids and sealing the ends of the braids.

2. Description of the Prior Art

The use of a braid cutter and braid end sealer is known in the prior art. More specifically, a braid cutter and braid end sealer heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,934,115; U.S. Pat. No. 4,739,151; U.S. Pat. No. 3,973,100; U.S. Pat. No. 4,254,324; U.S. Pat. No. 5,223,694; and U.S. Pat. No. Des. 343,918.

While these devices fulfill their respective, particular objectives and requirements, the aforementioned patents do not disclose a new braid clipper and sealing device. The inventive device includes a container having a bottom and top portions and two compartments in the bottom portion, one for receiving cutoff braids and one for storing either lighter fluid or gas, and further includes a recess in the top and a passage extending through the recess into one of the compartments. A first and second blade members are perpendicularly disposed in the passageway with the first blade member being attached to a retractable button which extends through a side of the container. A conduit extends from the compartment containing the fluid or gas and is connected to a burner which is disposed in the recess. A valve which is controlled by a valve control member is disposed in the burner. A rotatable sparking wheel is mounted proximate to the burner for lighting the fluid or gas coming up through the conduit.

In these respects, the braid clipper and sealing device according to the present invention substantially departs from the conventional concepts and designs of the prior art, and in so doing provides an apparatus primarily developed for the purpose of easily and carefully cutting braids and sealing the ends of the ends of the braids.

SUMMARY OF THE INVENTION

In view of the foregoing disadvantages inherent in the known types of a braid cutter and braid end sealer now present in the prior art, the present invention provides a new braid clipper and sealing device construction wherein the same can be utilized for easily and carefully cutting braids and sealing the ends of the ends of the braids.

The general purpose of the present invention, which will be described subsequently in greater detail, is to provide a new braid clipper and sealing device which has many of the advantages of the a braid cutter and braid end sealer mentioned heretofore and many novel features that result in a new braid clipper and sealing device which is not anticipated, rendered obvious, suggested, or even implied by any of the prior art a braid cutter and braid end sealer, either alone or in any combination thereof.

To attain this, the present invention generally comprises a container having a bottom and top portions and two compartments in the bottom portion, one for receiving cutoff braids and one for storing either lighter fluid or gas, and further includes a recess in the top and a passage extending through the recess into one of the compartments. A first and second blade members are perpendicularly disposed in the passageway with the first blade member being attached to a retractable button which extends through a side of the container. A conduit extends from the compartment containing the fluid or gas and is connected to a burner which is disposed in the recess. A valve which is controlled by a valve control member is disposed in the burner. A rotatable sparking wheel is mounted proximate to the burner for lighting the fluid or gas coming up through the conduit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new braid clipper and sealing device which has many of the advantages of the a braid cutter and braid end sealer mentioned heretofore and many novel features that result in a new braid clipper and sealing device which is not anticipated, rendered obvious, suggested, or even implied by any of the prior art a braid cutter and braid end sealer, either alone or in any combination thereof.

It is another object of the present invention to provide a new braid clipper and sealing device which may be easily and efficiently manufactured and marketed.

It is a further object of the present invention to provide a new braid clipper and sealing device which is of a durable and reliable construction.

An even further object of the present invention is to provide a new braid clipper and sealing device which is susceptible of a low cost of manufacture with regard to both materials and labor, and which accordingly is then susceptible of low prices of sale to the consuming public, thereby making such braid clipper and sealing device economically available to the buying public.

Still yet another object of the present invention is to provide a new braid clipper and sealing device which provides in the apparatuses and methods of the prior art some of the advantages thereof, while simultaneously overcoming some of the disadvantages normally associated therewith.

Still another object of the present invention is to provide a new braid clipper and sealing device for easily and carefully cutting braids and sealing the ends of the ends of the braids.

Yet another object of the present invention is to provide a new braid clipper and sealing device which includes a container having a bottom and top portions and two compartments in the bottom portion, one for receiving cutoff braids and one for storing either lighter fluid or gas, and further includes a recess in the top and a passage extending through the recess into one of the compartments. A first and second blade members are perpendicularly disposed in the passageway with the first blade member being attached to a retractable button which extends through a side of the container. A conduit extends from the compartment containing the fluid or gas and is connected to a burner which is disposed in the recess. A valve which is controlled by a valve control member is disposed in the burner. A rotatable sparking wheel is mounted proximate to the burner for lighting the fluid or gas coming up through the conduit.

Still yet another object of the present invention is to provide a new braid clipper and sealing device that is safer and more convenient to use.

Even still another object of the present invention is to provide a new braid clipper and sealing device that essentially simplifies the cutting of braids and then sealing the ends of the braids evenly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
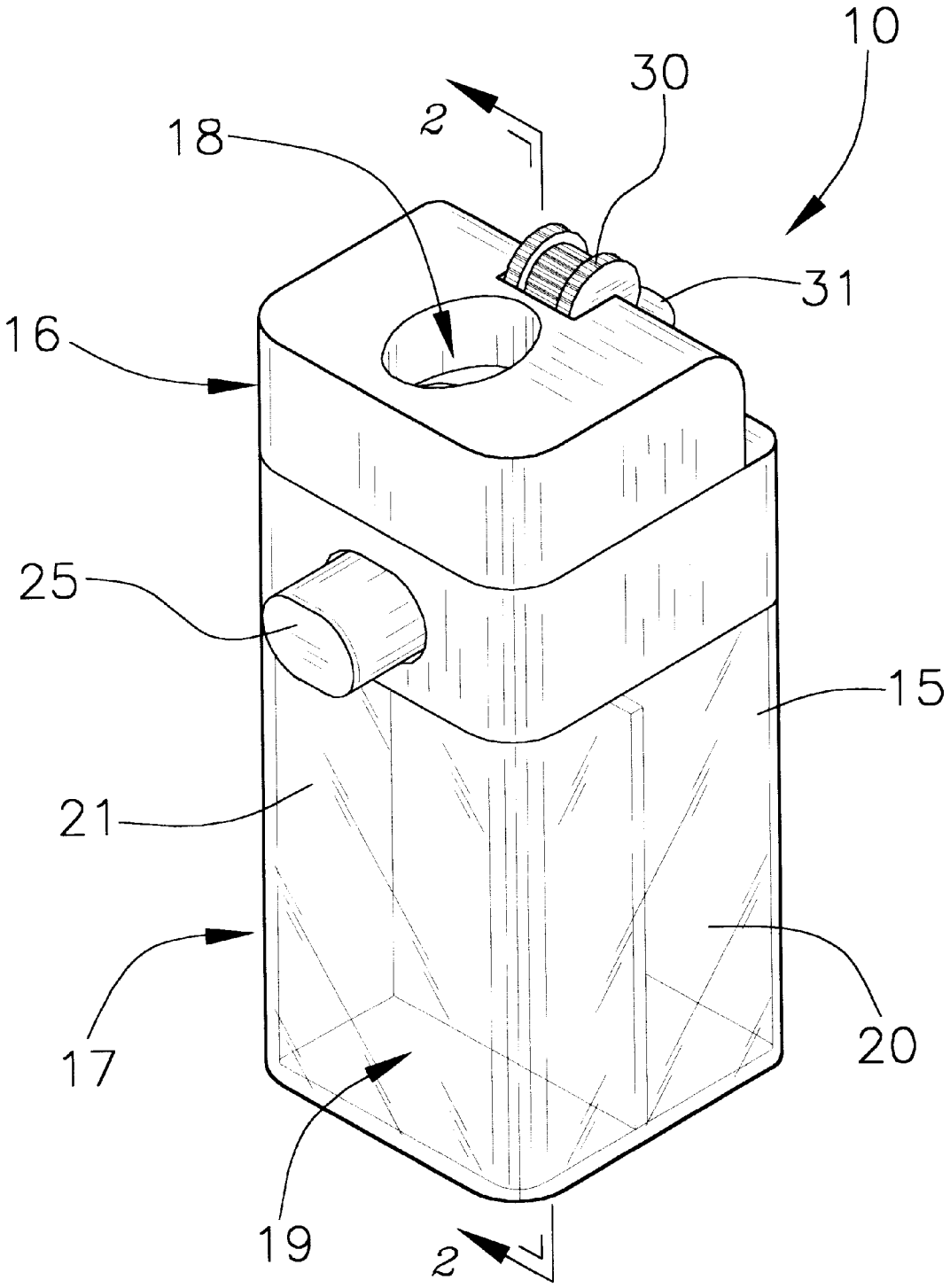
FIG. 1 is a perspective view of a new braid clipper and sealing device according to the present invention.
Figure 2:
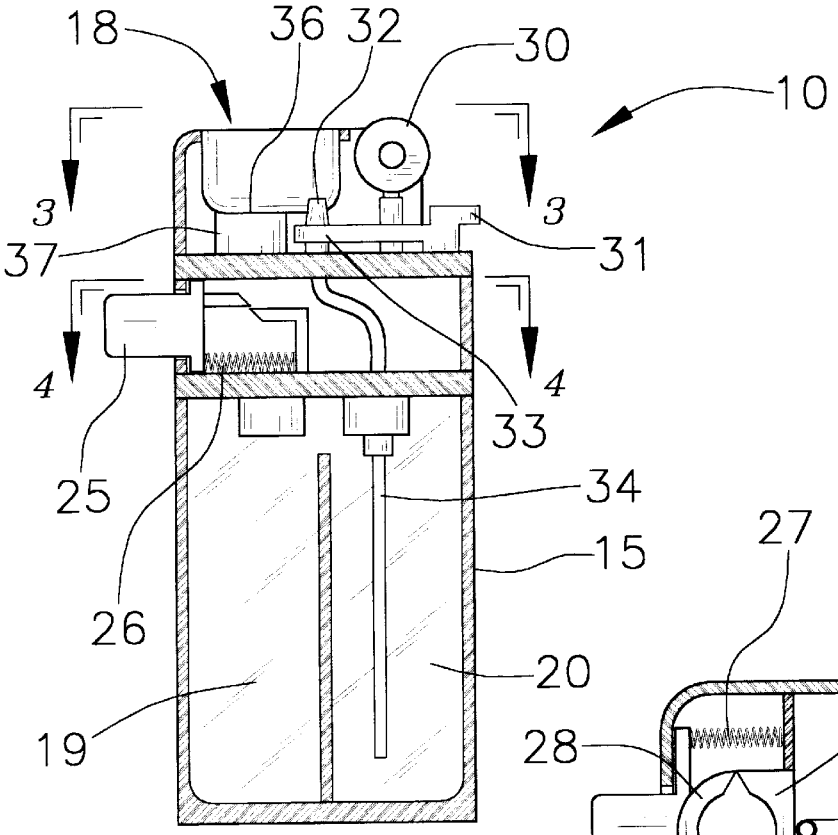
FIG. 2 is a side cross-sectional view of the present invention.
Figure 4A:
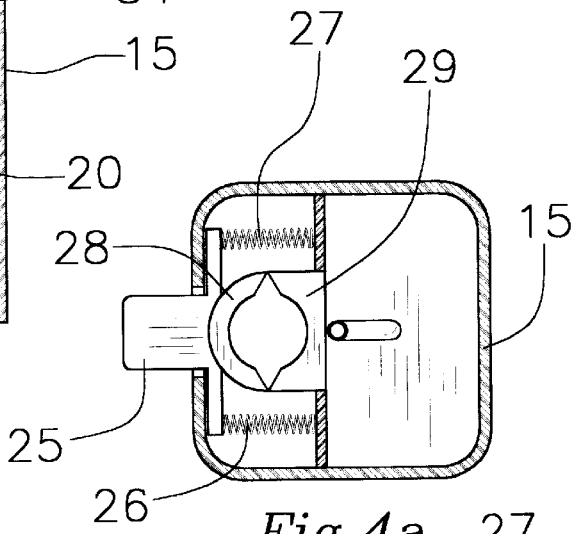
FIG. 4*a* is a top cross-section view of the present invention.
Figure 3:
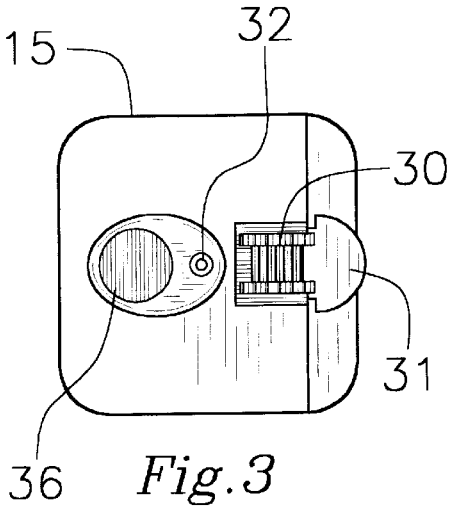
FIG. 3 is a top plan view of the present invention.
Figure 4B:
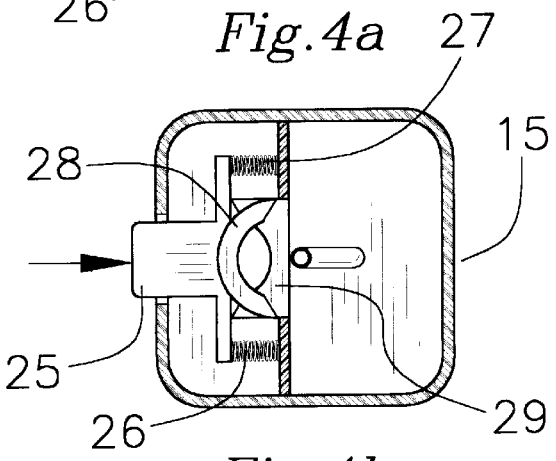
FIG. 4*b* is a top cross-sectional view of the present invention in use.

With reference now to the drawings, and in particular to FIGS. 1 through 4*b* thereof, a new braid clipper and sealing device embodying the principles and concepts of the present invention and generally designated by the reference numeral 10 will be described.

As best illustrated in FIGS. 1 through 4*b*, the braid clipper and sealing device 10 generally comprises a container 15 having a top portion 16 and a bottom portion 17 and further having two compartments 19,20 in the bottom portion 17. The container 15 also has a top and a side 21 and a recess 18 in the top, the recess 18 further having a bottom 36, an opening therethrough and a passageway 37 extending from the hole into one of the two compartments 19 and being adapted to receive braids therein. The other compartment 20 is adapted to store lighter fluid or gas.

The braid clipper and sealing device 10 further includes a first blade member 29 securely and conventionally disposed in the passageway 37; a second blade member 28 moveably disposed in the passageway 37; and a retractable button 25 connected to the second blade member 28 and moveably disposed through the side 21 of the container 15. The first blade member 29 being disposed generally parallel to the second blade member 28 with two springs 26,27 each having one end engageable to the button 25 and having another end engageable to an inside portion of the container 15. The first and second blade members 28,29 are disposed generally perpendicular inside the passageway 37 with the second blade member 28 being movable toward and away from the first blade member 29 and with a portion of the second blade member 28 being overlapable with a portion of the first blade member 29.

In addition, the braid clipper and sealing device 10 includes a burner 32 securely disposed in the recess 18 through the bottom 36 thereof; a conduit member 34 having a first end conventionally connected to the burner 32 and a second end extending into the second of two compartments 20 to move the fluid or gas to the burner 32; a valve 33 disposed in the burner 32; a valve control member 31 conventionally connected to the valve 33 and depressably and conventionally mounted to the container 15; and a sparking wheel 30 rotatably mounted with conventional means to the container 15 near the burner 32.

In use, a user inserts the end of the braid through the recess 18 into the passageway 37 and depresses the button 25 which urges the second blade member 28 across the passageway 37 and in combination with the first blade member 29 cuts off an end portion of the braid, and the user rotates and depresses the valve control member 31 to ignite the burner 32 which seals the end of the braid.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A braid clipper and sealer device for use with elongate braids having an end tip, the device comprising:

a container having a top portion and a bottom portion and further having at least one compartment in said bottom portion, said container further having a top and a side and a recess in said top, said recess further having a bottom and a perimeter wall extending from said bottom to an upper opening in said top, said bottom having an opening therethrough and a passageway extending from said opening into said at least one compartment, said passageway extending in a direction substantially perpendicular to said bottom, said recess being adapted to receive elongate braids oriented such that a length of the braids is oriented perpendicular to said bottom of said recess with the end tip of said braids being positioned adjacent to said bottom;

a means for cutting braids in said container; and a means for sealing ends of braids in said container, wherein said means for sealing ends of braids includes a burner disposed in said bottom of said recess for burning an end of braids inserted into said recess, said burner being adapted to create a flame extending upwardly in said recess and oriented in a direction substantially perpendicular to said opening in said bottom and substantially parallel to the length of said braids for contacting the end tips of said braids.

2. A braid clipper and sealer device as described in claim 1, wherein said at least one compartment is adapted to store lighter fluid or gas.

3. A braid clipper and sealer device as described in claim 2, wherein said means for sealing ends of braids includes a conduit member having a first end connected to said burner and a second end extending into said at least one compartment to move the fluid or gas to said burner; a valve disposed in said burner; a valve control member connected to said valve and depressably mounted to said container; and a sparking wheel rotatably mounted to said container near said burner.

4. A braid clipper and sealer device as described in claim 1, wherein said means for cutting braids includes a first blade member securely disposed in said passageway; a second blade member moveably disposed in said passageway; and a retractable button connected to said second blade member and moveably disposed through said side of said container.

5. A braid clipper and sealer device as described in claim 4, wherein said first blade member is disposed generally parallel to said second blade member.

6. A braid clipper and sealer device as described in claim 5, wherein said means for cutting braids further includes at least one spring having one end engageable to said button and having another end engageable to an inside portion of said container.

7. A braid clipper and sealer device as described in claim 6, wherein said first and second blade members are disposed generally perpendicular in said passageway.

8. A braid clipper and sealer device as described in claim 7, wherein said second blade member is movable toward and away from said first blade member with a portion of said second blade member being overlapable with a portion of said first blade member.

9. A braid clipper and sealer device comprising:

a container having a top portion and a bottom portion and further having at least one compartment in said bottom portion, said container further having a top and a side and a recess in said top, said recess further having a bottom, an opening therethrough and a passageway extending from said opening into said at least one compartment and being adapted to receive braids therein, said at least one compartment being adapted to store lighter fluid or gas;

a means for cutting braids in said container, and including a first blade member securely disposed in said passageway; a second blade member moveably disposed in said passageway; and a retractable button connected to said second blade member and moveably disposed through said side of said container, said first blade member being disposed generally parallel to said second blade member, said means for cutting braids further including at least one spring having one end engageable to said button and having another end engageable to an inside portion of said container, said first and second blade members being disposed generally perpendicular in said passageway, said second blade member being movable toward and away from said first blade member with a portion of said second blade member being overlapable with a portion of said first blade member; and a means for sealing ends of braids in said container, and including a burner disposed in said recess through said bottom thereof; a conduit member having a first end connected to said burner and a second end extending into said at least one compartment to move the fluid or gas to said burner; a valve disposed in said burner; a valve control member connected to said valve and depressably mounted to said container; and a sparking wheel rotatably mounted to said container near said burner.

* * * * *